US009757952B2

(12) United States Patent
Tanaka et al.

(10) Patent No.: US 9,757,952 B2
(45) Date of Patent: Sep. 12, 2017

(54) CONTROL METHOD OF A PRINTING DEVICE, AND A PRINTING DEVICE

(71) Applicant: Seiko Epson Corporation, Tokyo (JP)

(72) Inventors: Atsushi Tanaka, Matsumoto (JP); Takeshi Komaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/292,585

(22) Filed: Oct. 13, 2016

(65) Prior Publication Data

US 2017/0113469 A1 Apr. 27, 2017

(30) Foreign Application Priority Data

Oct. 26, 2015 (JP) ..... 2015-209623

(51) Int. Cl.
*B41J 2/175* (2006.01)

(52) U.S. Cl.
CPC ..... *B41J 2/17566* (2013.01)

(58) Field of Classification Search
CPC .... B41J 2/17566; B41J 2/175; B41J 2/17523; B41J 2/17506; B41J 2/17503; B41J 2/17509; B41J 29/02; B41J 2002/17589
See application file for complete search history.

(56) References Cited

U.S. PATENT DOCUMENTS 7,997,707 B2 * 8/2011 Shimizu ..... B41J 2/17509 347/85
8,317,282 B2 * 11/2012 Satoh ..... B41J 2/17509 347/7

FOREIGN PATENT DOCUMENTS

JP 2001-113716 A 4/2001
JP 2013-248757 A 12/2013

* cited by examiner

*Primary Examiner* — Thinh H Nguyen
(74) *Attorney, Agent, or Firm* — Foley & Lardner LLP

(57) ABSTRACT

Printing can continue while replacing ink cartridges. The printer 1 detects and reports an ink supply disabled state in which ink cannot be supplied from ink cartridges 9*a* to 9*d*. If a cover-open state, in which the cover 8*a* that opens and closes the cartridge holder 8 is open, is detected and the ink supply disabled state is also detected while printing is in progress, printing is permitted to continue using ink in buffer tanks (pressure control chambers 13*a* to 13*d*) while displaying a warning instead of going to an error state. Interruptions to printing due to a cover-open error while replacing ink cartridges 9*a* to 9*d* can therefore be avoided.

11 Claims, 6 Drawing Sheets

CONTROL METHOD OF A PRINTING DEVICE, AND A PRINTING DEVICE

BACKGROUND

1. Technical Field

The present invention relates to a printing device and a control method of a printing device that prints using ink supplied from a cartridge (ink cartridge).

2. Related Art

Printing devices (printers) that print using ink supplied from a cartridge can continue printing when the ink in the cartridge runs out by accessing an (auxiliary) buffer tank (or cartridge) in place of the empty cartridge. So that printing is not interrupted while the empty cartridge is replaced, this type of printer stores ink in a buffer tank disposed (positioned) in the ink path between the cartridge and the printhead. By using ink from the buffer tank, printing can continue while the empty cartridge is replaced. Japanese published patent application JP-A-2013-248757 describes an example of such a printing device (an inkjet printer).

Some printers also have a cover on the outside case that opens and closes to replace an ink cartridge and for maintenance purposes.

SUMMARY

The present invention prevents problems from occurring when such a cover is opened while printing, and enables continuing printing while replacing a cartridge.

One aspect of the invention is a control method of a printing device configured to supply ink from an ink cartridge installed in a cartridge holder through a buffer tank to a printhead, the control method including: detecting if the ink in the ink cartridge is less than or equal to a specific amount and in an ink-end state (ink supply disabled state); detecting if a cover that opens and closes the cartridge holder is open (cover-open state) or is closed (cover-closed state); stopping printing if not in the ink-end state and the cover-open state is detected while printing; and continuing printing using ink in the buffer tank if the ink-end state was detected and the cover-open state is detected while printing.

Another aspect of the invention is a printing device having: a cartridge holder in which an ink cartridge is installed; a cover configured to open and close the cartridge holder; a first detection unit (sensor) configured to detect a cover-open state in which the cover is open and a cover-closed state in which the cover is closed; a printhead configured to print by ejecting ink supplied from the ink cartridge; a buffer tank disposed in an ink supply path from the cartridge holder to the printhead; and a second detection unit (sensor) configured to detect an ink-end state in which the amount of ink in the ink cartridge is less than or equal to a specific amount of ink. The printing device stops printing with the printhead when the second detection unit does not detect the ink-end state and the first detection unit detects the cover-open state while printing with the printhead; and continues printing with the printhead using ink in the buffer tank when the second detection unit detects the ink-end state and the first detection unit detects the cover-open state while printing with the printhead.

This configuration can detect an ink supply disabled state in which ink cannot be supplied from the ink cartridge based on the output of a remaining ink sensor or the total amount of ink ejected from the printhead to print, and can therefore know if there is an ink-end state in which the ink cartridge is empty or if the ink cartridge was removed for replacement. Furthermore, if a cover-open state of the cover that opens and closes the cartridge holder is detected while printing even though an ink-end state was not detected, the cover was likely opened unnecessarily when not required to replace an ink cartridge, and printing is therefore stopped to prevent printing problems due to contact with the moving printhead or an ink cartridge being removed and not replaced. However, if the ink supply disabled state is detected, the cover may have been opened to replace an ink cartridge, and if printing is in progress, printing is continued using ink in the buffer tank instead stopping printing (returning an error). Therefore, if the cover is opened as usual to replace an ink cartridge, printing will not be disabled because the cover was opened to replace a cartridge. Printing being interrupted while replacing ink cartridges can therefore be avoided.

In the printing device and control method therefor according to the invention, supplying ink from the ink cartridge installed in the cartridge holder to the buffer tank by a pump can be initiated if changing from the cover-open state to the cover-closed state is detected while printing using ink in the buffer tank.

Based on detecting that the cover closed, this configuration determines that replacing the ink cartridges was completed and can then replace the ink that was consumed from the buffer tank while the ink cartridges were being replaced.

In the printing device and control method therefor according to the invention, the pump is a diaphragm pump configured to supply ink to the buffer tank, the diaphragm pump has a displaceable diaphragm whose displacement changes the capacity of a pump ink chamber; and the ink-end state can be detected based on displacement of the diaphragm.

Because the specific displacement of the diaphragm when ink cannot be suctioned into the pump ink chamber of the diaphragm pump means that ink cannot be supplied from the ink cartridge, an ink supply disabled state can be detected based on this displacement. By using this detection method, there is no need to detect the end of ink based on total ink consumption, and the ink supply disabled state can be accurately detected.

In the printing device and control method therefor according to the invention, printing preferably stops when a cover-open state is detected while printing with the buffer tank if the amount of ink in the buffer tank is determined to be less than a specific amount of ink. This specific amount of ink is preferably based on an amount of ink needed to complete the current print job (printing operation).

This configuration interrupts (stops) printing when there is not enough ink in the buffer tank when an ink cartridge is replaced. Continuing to print when ink cannot be supplied from the buffer tank can therefore be avoided.

In the printing device and control method therefor according to the invention, a warning is preferably issued if the printing device is in the ink supply disabled state and printing is in progress when a cover-open state is detected.

Because an error is not returned and a warning is issued if a cover-open state is detected while replacing ink cartridges, the user can be warned that the cover is open without interrupting printing.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of a printing device and a control method therefor according to the present invention are described below with reference to the accompanying figures. The printing device and control method of the invention are useful for an inkjet printer that prints by ejecting ink from an inkjet head, and to a control method for the inkjet printer.

Printer

Figure 1:
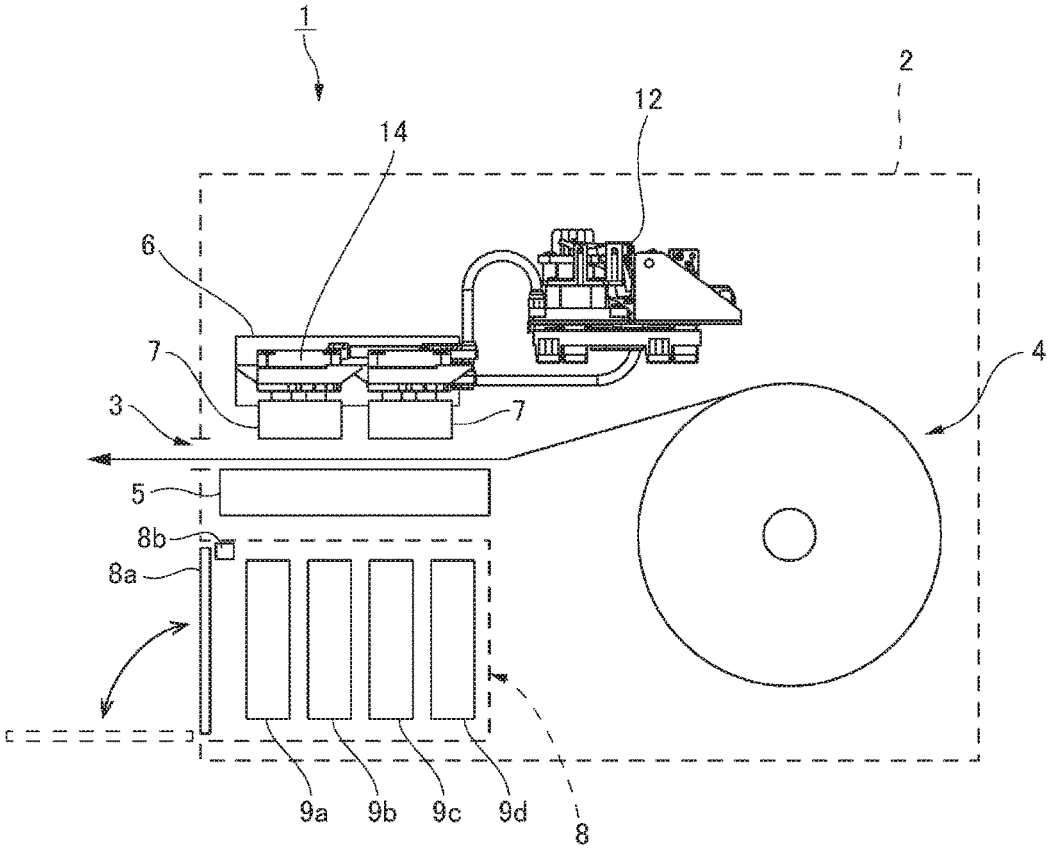
FIG. 1 illustrates a configuration of a printer in accord with the present invention.

FIG. 1 illustrates the configuration of a printer 1 in accord with the present invention. The printer 1 (printing device) prints to continuous recording paper delivered from a paper roll using a plurality of different inks. The printer 1 has an exemplary rectangular box-like printer case 2. A paper exit 3 is formed in the front of the printer case 2, and a roll paper compartment 4 is provided inside the printer case 2 at a position towards the back of the printer. The recording paper delivered from the paper roll held in the roll paper compartment 4 is conveyed horizontally through a recording paper conveyance path that passes the surface of a platen 5 disposed just before the paper exit 3.

A carriage 6 and an inkjet head 7 (printhead) mounted on the carriage 6 are disposed above the platen 5. The carriage 6 is supported movably up and down by a carriage guide mechanism not shown. The inkjet head 7 can move by the vertical movement of the carriage between a printing position where a specific gap is formed between the surface of the platen 5 and the recording paper passing over the platen 5, and a retracted position where the inkjet head 7 is moved up from the printing position. The printer 1 conveys the recording paper fed from the paper roll over the surface of the platen 5 by a recording paper conveyance mechanism not shown, and prints on the recording paper by ejecting ink from the inkjet head 7 in conjunction with conveyance of the recording paper.

A cartridge holder 8 is disposed below the platen 5. Ink cartridges 9*a* to 9*d* respectively storing four different colors of ink, cyan, magenta, yellow, and black in this example, are installed to the cartridge holder 8. When the ink cartridges 9*a* to 9*d* are installed in the cartridge holder 8, ink supply needles (not shown) disposed at the inside back of the cartridge holder 8 are inserted into ink supply ports (not shown) disposed to the back ends of the ink cartridges 9*a* to 9*d*. As a result, the ink cartridges 9*a* to 9*d* are connected to the upstream ends of the ink supply paths 10 (FIG. 2) through which ink is supplied to the inkjet head 7.

A diaphragm pump unit 12 is disposed toward the back end side of the carriage 6 and inkjet head 7. The diaphragm pump unit 12 has subtanks 11*a*, 11*b*, 11*c*, and 11*d* (see FIG. 2) for respectively storing the colors of ink, cyan, magenta, yellow, and black. A damper unit 14 having pressure control chambers 13*a*, 13*b*, 13*c*, and 13*d* (see FIG. 2) is disposed above the inkjet head 7.

Figure 2:
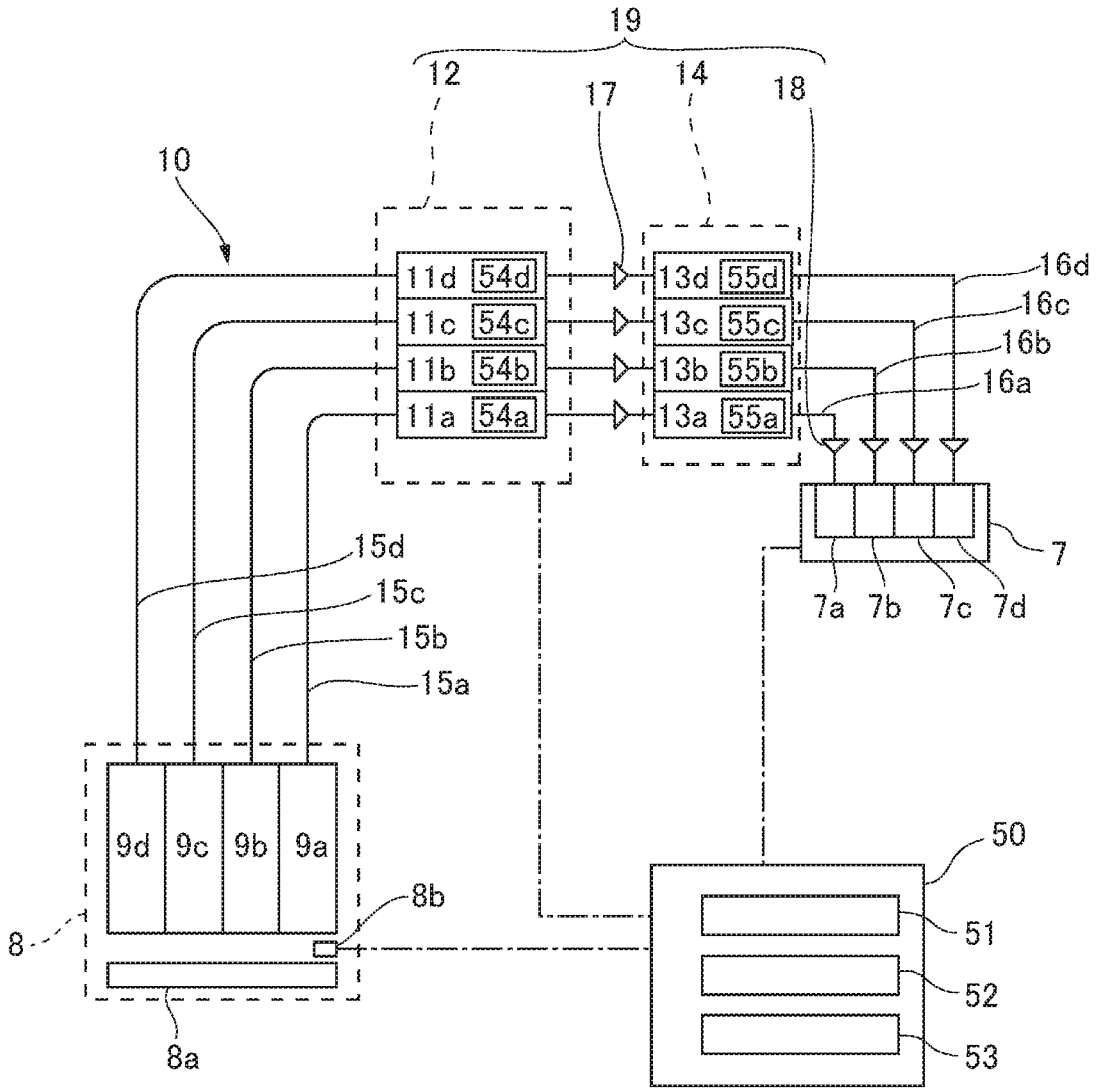
FIG. 2 illustrates an ink supply system and control system of the printer.

FIG. 2 describes the ink supply system and the control system of the printer 1. The ink-flow supply path 10 from the cartridge holder 8 to the inkjet head 7 include multiple sequentially coupled sets of ink channels (or ink paths or ink channel busses). Coming out of cartridge holder 8 along the downstream direction of ink-flow supply path 10 are four ink paths (channels) 15*a*, 15*b*, 15*c*, and 15*d* that respectively connect four ink cartridges 9*a*, 15*b*, 15*c*, and 9*d* to four subtanks 11*a*, 11*b*, 11*c*, and 11*d*, which are part of diaphragm unit 12. Ink from the ink cartridges 9*a* to 9*d* is suctioned through the ink paths 15*a* to 15*d* into their respective subtanks 11*a* to 11*d* by an ink suction operation of the diaphragm pump unit 12. The ink is held in the subtanks 11*a* to 11*d* until being supplied to the inkjet head 7 along the downstream direction of the ink-flow supply path through backflow prevention valves 17, damper unit 14, respective ink paths 16*a* to 16*b*, and backflow prevention valves 18. Ink paths (channels) 16*a*, 16*b*, 16*c*, and 16*d* respectively convey ink from the subtanks 11*a*, 11*b*, 11*c*, and 11*d* of diaphragm pump unit 12 to internal ink paths 7*a*, 7*b*, 7*c*, and 7*d* of the inkjet head 7.

The damper unit 14 is disposed upstream from ink paths 16*a* to 16*d*, and backflow prevention valves 17 are disposed upstream from the damper unit 14. The backflow prevention valves 18 are disposed upstream from ink paths 16*a* to 16*d* and downstream from the inkjet head 7. Ink stored in the subtanks 11*a* to 11*d* is supplied through the backflow prevention valves 17 to the pressure control chambers 13*a* to 13*d* of the damper unit 14, and from there through the backflow prevention valves 18 to the internal paths 7*a* to 7*d* of the inkjet head 7. The diaphragm pump unit 12, backflow prevention valves 17, damper unit 14, and the backflow prevention valves 18 embody an ink supply mechanism 19 for supplying ink from the ink cartridges 9*a* to 9*d* to the inkjet head 7 along the ink-supply path.

As shown in FIG. 1 and FIG. 2, a cover 8*a* for opening and closing the space in which the ink cartridges 9*a* to 9*d* are held, and a cover open sensor 8*b* (first detection unit) for detecting if the cover 8*a* is open or closed, are also disposed to the cartridge holder 8. The cover 8*a* is disposed to the front of the printer 1, and opens to the front pivoting on the bottom end of the cover 8*a*. The cover open sensor 8*b* is preferably a contact sensor, for example, and the output changes to on or off when the cover 8*a* opens.

As shown in FIG. 2, diaphragm pump unit 12 includes first remaining ink sensors 54*a* to 54*d* (second detection units) for respectively detecting if the ink remaining in the subtanks 11*a* to 11*d* has gone below a predefined reference level. Based on the output of the first remaining ink sensors 54*a* to 54*d*, the diaphragm pump unit 12 performs an operation replenishing the subtanks 11*a* to 11*d* with ink, as needed. Similarly, the damper unit 14 includes second remaining ink sensors 55*a* to 55*d* for detecting how much ink remains in the pressure control chambers 13*a* to 13*d*.

Control System

As shown in FIG. 2, the control system of the printer 1 has a controller 50 including at least one CPU, ROM, RAM, and other peripheral circuits. The controller 50 connects to a host device (host computer), not shown, and receives print data and commands from the host device. When print data is received, the controller 50 controls the recording paper conveyance mechanism, not shown, to convey the recording paper delivered from the paper roll over the surface of the platen 5, and prints on the recording paper by ejecting ink droplets from the inkjet head 7 onto the recording paper in conjunction with the media conveyance operation.

The controller 50 includes an ink-end evaluation unit 51, a cover open evaluation unit 52, and a remaining ink evaluation unit 53. Based on the output of the first remaining ink sensors 54*a* to 54*d* disposed in the diaphragm pump unit 12, the ink-end evaluation unit 51 detects (determines) an ink supply disabled state in which ink cannot be supplied from the ink cartridges 9*a* to 9*d* to the subtanks 11*a* to 11*d*. Based on the output of the cover open sensor 8*b*, the cover open evaluation unit 52 detects a cover-open state in which the cover 8*a* is open or a cover-closed state in which the cover 8*a* is closed. Based on the output of the second remaining ink sensors 55*a* to 55*d*, the remaining ink evaluation unit 53 detects (determines) the amount of ink that can be supplied from the pressure control chambers 13*a* to 13*d* to the inkjet head 7.

Diaphragm Pump Unit

Figure 3:
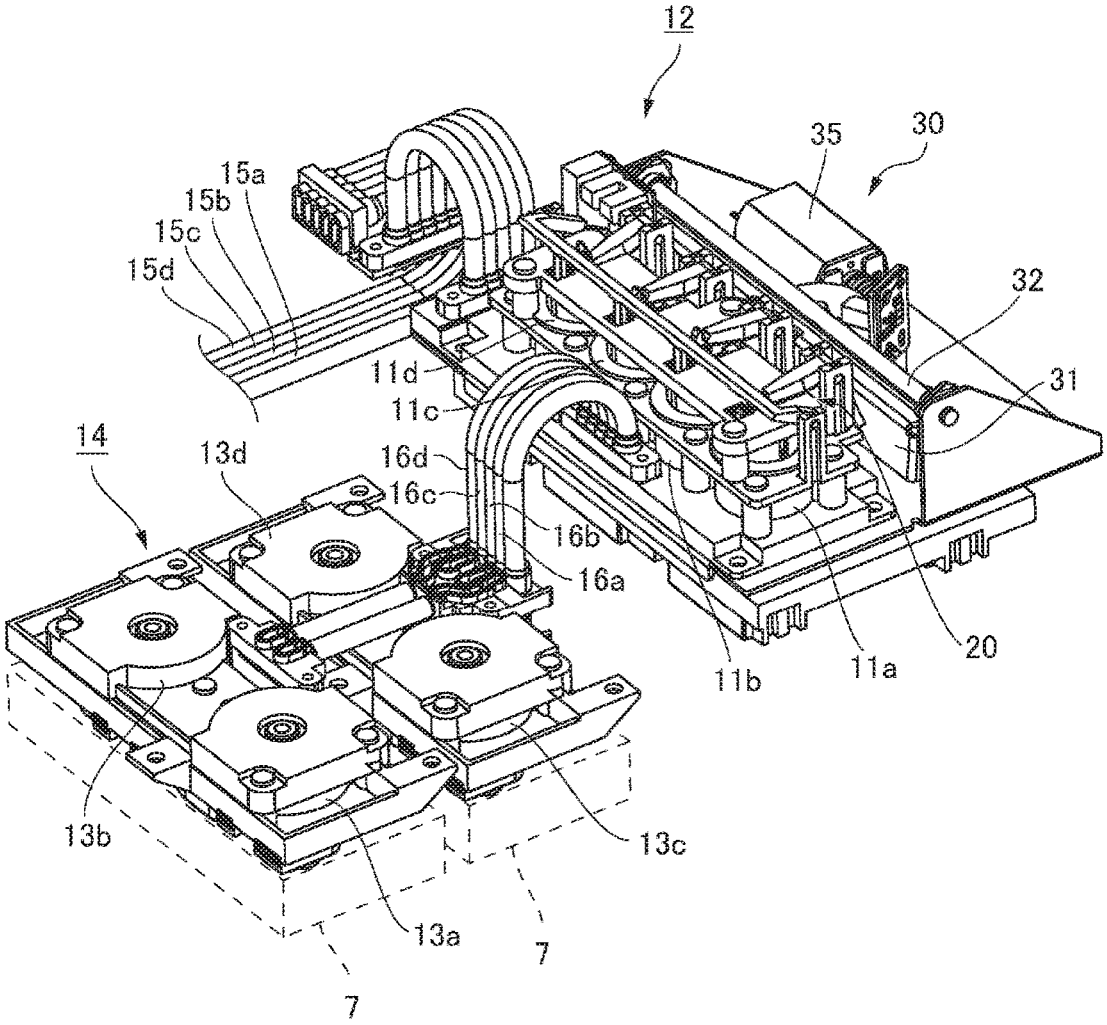
FIG. 3 is an oblique view of a subtank, diaphragm pump unit, and damper unit in accord with the present invention.
Figure 4:
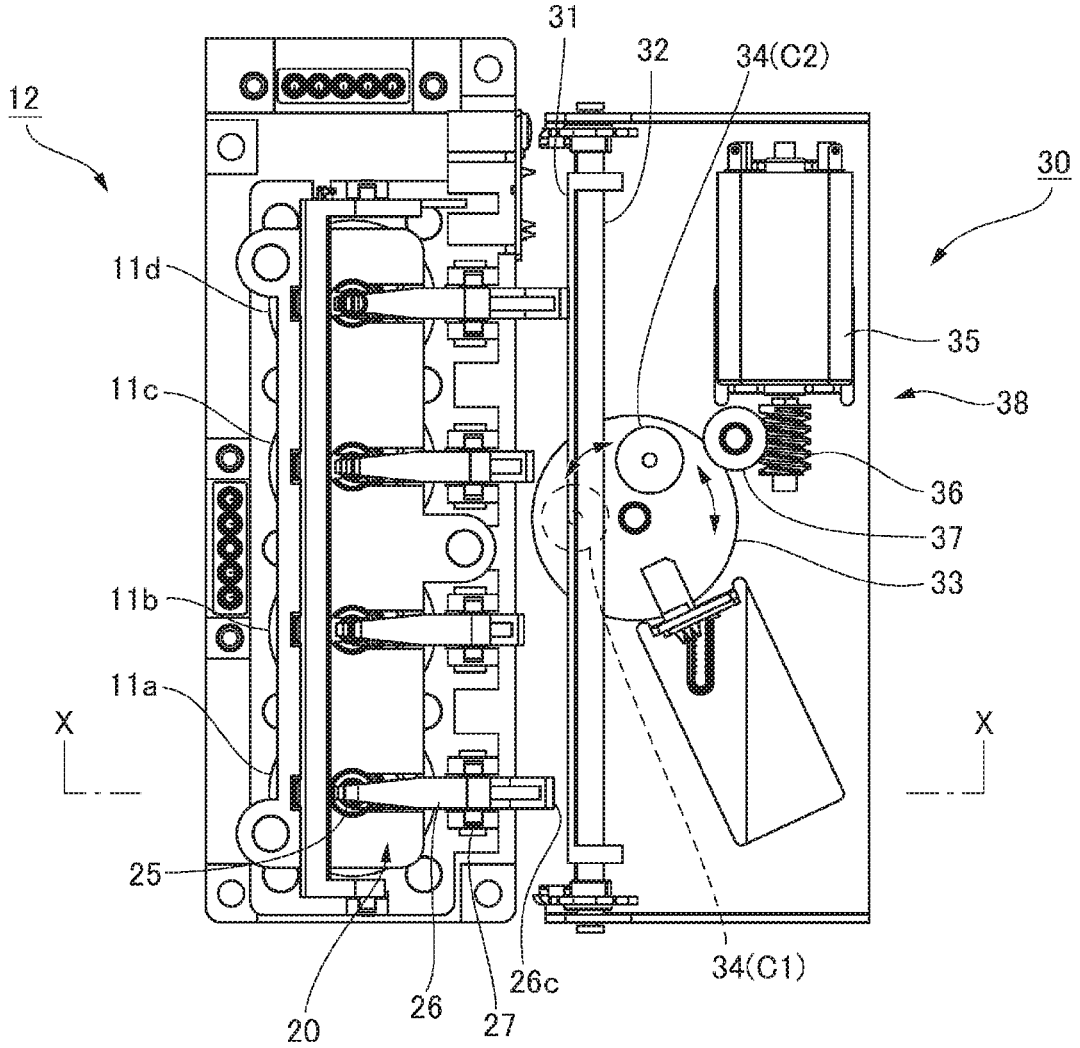
FIG. 4 is a plan view of the subtank and diaphragm pump unit.

FIG. 3 is an oblique view of the diaphragm pump unit 12 and damper unit 14. FIG. 4 is a plan view of the diaphragm pump unit 12, and FIG. 5 is a section view of the main parts of the diaphragm pump unit 12 through line X-X in FIG. 4.

As shown in FIG. 3, the diaphragm pump unit 12 has an ink suction mechanism 20 disposed to the top of each subtank 11*a* to 11*d*, and a drive mechanism 30 disposed near the subtanks 11*a* to 11*d*. The ink suction mechanism 20 is a mechanism for suctioning ink from the ink cartridges 9*a* to 9*d* into corresponding subtanks 11*a* to 11*d*, and the drive mechanism 30 is a mechanism for driving the ink suction mechanism 20.

Figure 5:
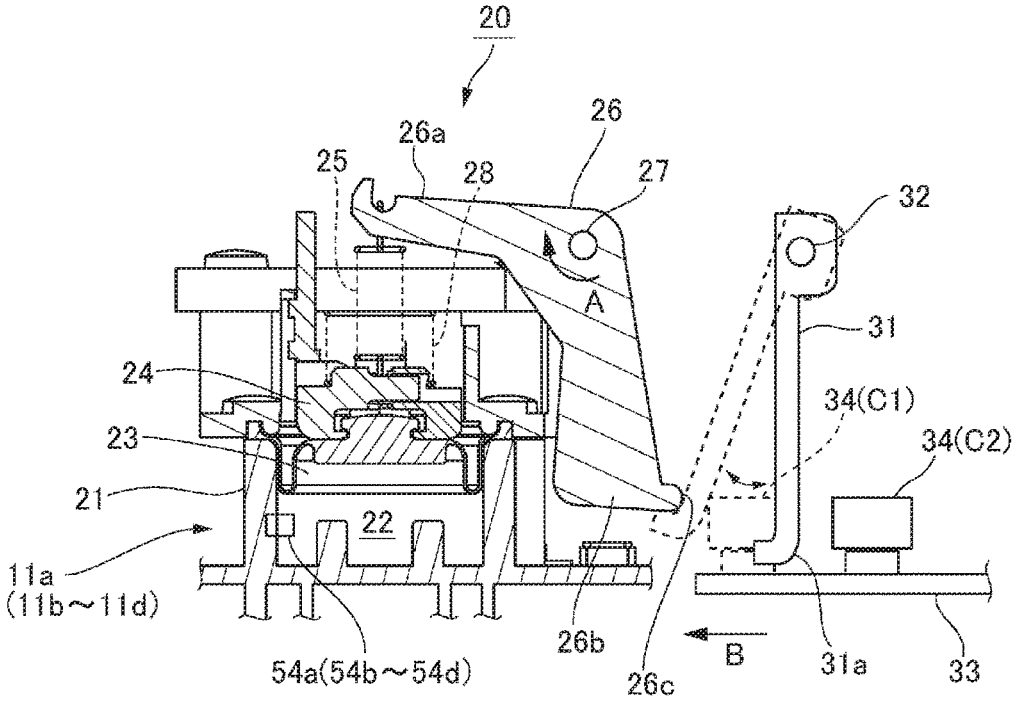
FIG. 5 is a section view of main parts of the subtank and diaphragm pump unit through line X-X of FIG. 4.

As shown in FIG. 5, subtank 11*a* (and similarly each of subtanks 11*b* to 11*d*) has a tubular cylinder 21 that rises vertically. An ink chamber 22 is disposed toward the bottom of the cylinder 21. A diaphragm 23 is attached to the cylinder 21 and covers the top of the ink chamber 22.

The ink suction mechanism 20 includes the diaphragm 23, a piston 24 connected to the diaphragm 23, a coil spring 25 attached to the top of the piston 24, and a suction lever 26 extending in an L-shaped configuration from the top of the coil spring 25 to a side of the cylinder 21.

The suction lever 26 has a first arm 26*a* extending horizontally from the support pivot 27 toward the top of the cylinder 21, and a second arm 26*b* extending down from the support pivot 27. The distal end of the first arm 26*a* is connected to the top end of the coil spring 25.

In an ink replenishing operation, the suction lever 26 is made to pivot in a direction causing its first arm 26*a* to rise (in the direction of arrow A in FIG. 5) by operation of the drive mechanism 30, as described below. When the first arm 26*a* rises, the piston 24 connected thereto rises and stretches the coil spring 25, and the diaphragm 23 is thereby pulled up by the elastic restoring force of the coil spring 25. As a result, the volume of the ink chamber 22 increases, the internal pressure of the ink chamber 22 decreases, and ink is suctioned from the ink cartridge 9*a* (or similarly ink cartridges 9*b* to 9*d*) into its respective ink chamber 22. Backflow of ink from its corresponding pressure control chamber 13*a* (or similarly pressure control chamber 13*b* to 13*d*) is prevented by a corresponding backflow prevention valve 17 during the ink replenishing operation.

A first remaining ink sensor 54*a* (or similarly any of first remaining ink sensors 54*b* to 54*d*) is disposed in the ink chamber 22. The first remaining ink sensor 54*a* (or 54*b* to 54*d*) has a lever or other detection member disposed at a position near the bottom inside the cylinder 21, and detects vertical displacement of the diaphragm 23 by this detection member. The first remaining ink sensor 54*a* (or 54*b* to 54*d*) detects when the diaphragm 23 moves from a previously set reference position to a low volume side of the ink chamber 22. In other words, it detects when the remaining ink in the ink chamber 22 goes below a reference value.

As shown in FIG. 4, the subtanks 11*a* to 11*d* are disposed in a row. Four ink suction mechanisms 20 are likewise disposed in a row, one above each corresponding subtank 11*a* to 11*d*.

The drive mechanism 30 includes a pressure lever 31 disposed at a position opposite (adjacent) a distal end 26*c* (see FIG. 5) of the four second arms 26*b*, all of which extend in the same direction. The drive mechanism 30 further includes a round gear 33 disposed below the pressure lever 31, and a roller 34 attached near the outside circumference of the gear 33 (see FIG. 4).

A worm gear 36 connected to an output shaft of a (electric) motor 35 and a worm wheel 37 that meshes with the worm gear 36 are disposed at a position beside the gear 33. When the output rotation of the motor 35 is transferred through the output shaft, the worm gear 36, and the worm wheel 37 to the gear 33, the roller 34 disposed near the outside circumference of gear 33 moves in a circular path. When the roller 34 moves from a retracted position C2 to a drive position C1, a bottom end 31*a* (see FIG. 5) of the pressure lever 31 moves to the distal end 26*c* of the second arm 26*b* (in the direction of arrow B in FIG. 5). As a result, the pressure lever 31 causes the suction lever 26 to move in rocking direction A. The first arm 26*a* therefore rises, and the diaphragm 23 is pulled up (second direction) through the coil spring 25 and piston 24. Because negative pressure is thereby produced inside the ink chamber 22, ink is supplied (suctioned) to the ink chamber 22.

The diaphragm pump unit 12 also has a compression spring 28 attached to the top of each piston 24. The compression spring 28 pushes the diaphragm 23 down through the piston 24. When the roller 34 returns to the retracted position C2 timed to the end of refilling the ink chamber 22 with ink, the suction lever 26 is released and can move freely again. As a result, because the piston 24 can descend, the diaphragm 23 is pushed down by compression spring 28 through the piston 24, and the diaphragm 23 descends to where the pressure from the compression spring 28 and the ink pressure on the diaphragm 23 are balanced. The diaphragm pump unit 12 thus pressurizes and supplies ink to the inkjet head 7 by the urging force of the compression spring 28.

Buffer Tank

Figure 6:
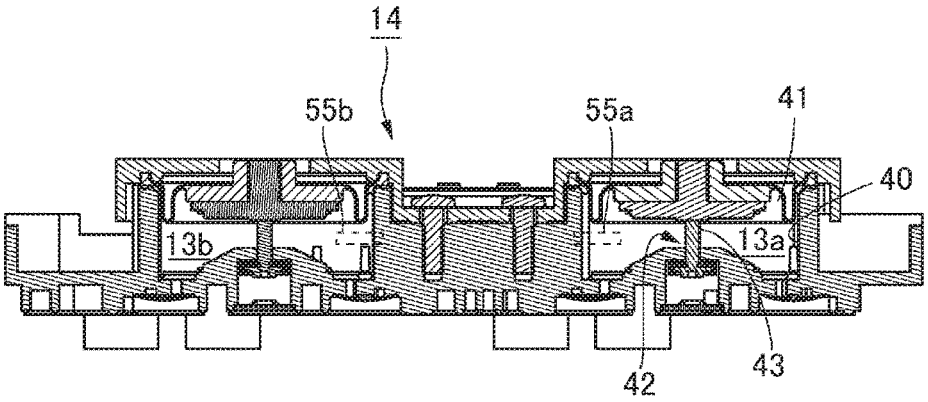
FIG. 6 is a section view of the damper unit.

FIG. 6 is a section view of the damper unit 14 through pressure control chambers 13*a* and 13*b*. The pressure control chamber 13*a* (buffer tank) has a chamber 40 of a specific volume with a diaphragm 41 covering the top of the chamber 40. An ink path entrance 42 connecting the subtank 11*a* to the ink path 16*a* is disposed in the bottom center of the chamber 40. The bottom end of a pressure adjustment spring 43 is attached to the ink path entrance 42, and the top end of the pressure adjustment spring 43 is attached to the center of the bottom of the diaphragm 41. The diaphragm 41 is urged by the pressure adjustment spring 43. A second remaining ink sensor 55*a* is disposed in the pressure control chamber 13*a* at a specific height. The other pressure control chambers 13*b* to 13*d* are similarly configured, but are coupled to corresponding subtanks 11*b* to 11*d* and ink paths 16*b* to 16*d*.

Ink in the subtanks 11*a* to 11*d* is supplied through the pressure control chambers 13*a* to 13*d* to the inkjet head 7. The damper unit 14 buffers sudden variations in the ink pressure on the upstream side of the pressure control chambers 13*a* to 13*d* by the force of the pressure adjustment spring 43. The second remaining ink sensors 55*a* to 55*d* disposed in the pressure control chambers 13*a* to 13*d* detect displacement of the diaphragms 41.

Operation of the ink suction mechanism 20 and drive mechanism 30 produces negative pressure in the subtanks 11*a* to 11*d*, and ink is not supplied to subtanks 11*a* to 11*d* from subtanks 11*a* to 11*d* while the subtanks 11*a* to 11*d* are being refilled. However, if ink is consumed on the inkjet head 7 side while the subtanks 11*a* to 11*d* are being refilled, the diaphragms 41 and the pressure adjustment springs 43 of the pressure control chambers 13*a* to 13*d* are displaced as the pressure in the internal paths 7*a* to 7*d* drops, and ink from the pressure control chambers 13*a* to 13*d* is supplied to the internal paths 7*a* to 7*d*. In other words, the pressure control chambers 13*a* to 13*d* function as buffer tanks to supply ink to the inkjet head while ink is not being supplied from the subtanks 11*a* to 11*d*. The ink supply from the pressure control chambers 13*a* to 13*d* thus enables the inkjet head 7 to continue ejecting ink for a limited time after subtanks 11*a* to 11*d* stop supplying ink.

Ink End Detection

Based on output from the first remaining ink sensors 54*a* to 54*d*, the ink-end evaluation unit 51 detects (determines) an ink supply disabled state, which is a state when ink is not able to be supplied from the ink cartridges 9*a* to 9*d* to the subtanks 11*a* to 11*d*. If the amount of ink in the subtanks 11*a* to 11*d* drops below a reference level, the ink supply system and control system of this embodiment determines that the subtanks 11*a* to 11*d* must be refilled and controls the drive mechanism 30 to rock the suction levers 26 to create negative pressure in the ink chambers 22 and suction ink from the ink cartridges 9*a* to 9*d*. The amount of ink in the ink cartridges 9*a* to 9*d* decreases each time the subtanks 11*a* to 11*d* are refilled, and the internal pressure of ink cartridges 9*a* to 9*d* decreases accordingly. As the internal pressure drops, suctioning ink from ink cartridges 9*a* to 9*d* by the negative pressure formed inside the ink chamber 22 gradually becomes more difficult, and the time required to suction ink gradually increases. When the ink cartridges 9*a* to 9*d* are nearly empty (an ink-end state), ink is not suctioned and the output of the first remaining ink sensors 54*a* to 54*d* does not change, even during an ink replenishing operation. When the remaining ink level is below the reference level even though the ink suction mechanism 20 and drive mechanism 30 actively suctioned ink, the ink-end evaluation unit 51 identifies (discerns the occurrence of, or issues) the ink supply disabled state accompanying the ink-end state.

The ink-end evaluation unit 51 may also detect an ink-end state (ink supply disabled state) if another ink level sensor, not shown, (third detection unit) that detects the amount of ink in the ink cartridges 9*a* to 9*d* detects the remaining ink in ink cartridges 9*a* to 9*d* is below a specific level. The ink-end evaluation unit 51 may also calculate the amount of ink remaining of each color ejected from the inkjet head 7, subtract the calculated remaining ink levels from the ink levels of full ink cartridges (9*a* to 9*d*), which is stored in memory, and if the resulting difference is below a specific level, the ink-end evaluation unit 51 may also use this information to identify an ink-end state (ink supply disabled state).

The following describes how to control avoiding print interruptions due to a cover open error while replacing an ink cartridge.

Figure 7:
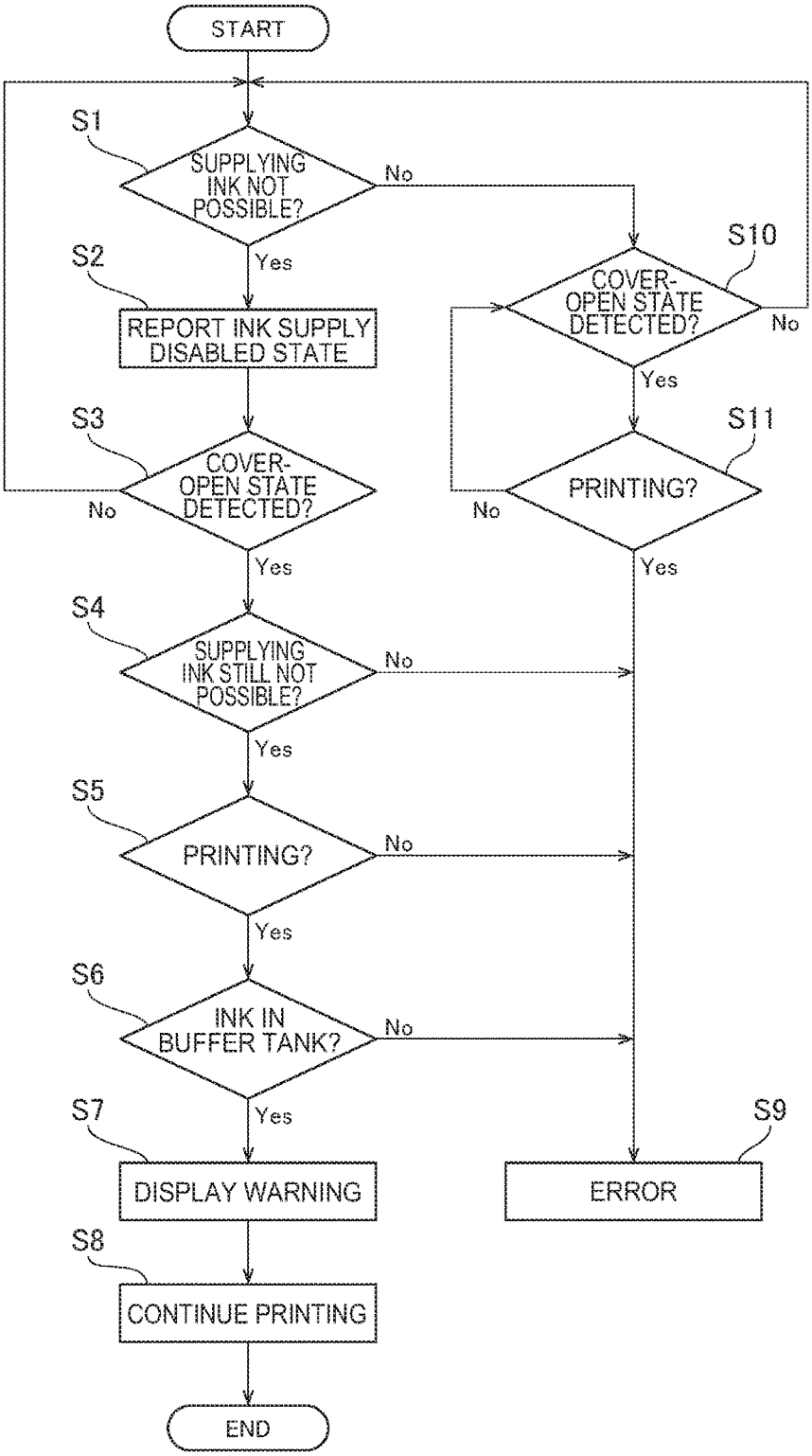
FIG. 7 is a control flow chart based on detection of an ink supply disabled state and a cover-open state.

FIG. 7 is a flow chart of a control process based on detection of an ink supply disabled state and a cover-open state. While printing, while waiting to print, and during initialization, the controller 50 monitors if an ink supply disabled state, as described above, has occurred, such as from ink ejection. If the ink-end evaluation unit 51 detects an ink supply disabled state (step S1: Yes), it executes a process reporting that ink cannot be supplied (step S2). For example, the ink-end evaluation unit 51 may execute a process that displays a prompt to replace an ink cartridge on a display of the operating panel of the printer 1, or may drive an LED indicator in a specific pattern that conveys a similar message. Further alternatively, the ink-end evaluation unit 51 may send to the host device a command reporting the ink supply disabled state and may further cause the host device to display a prompt to replace an ink cartridge. The controller 50 continues reporting the ink supply disabled state until ink can be supplied again.

The controller 50 also monitors by the cover open evaluation unit 52 whether or not the cover 8*a* of the cartridge holder 8 is open or closed, and detects if the cover 8*a* is opened (step S3). The cover 8*a* may be opened while printing, while waiting to print, or during initialization to replace ink cartridges 9*a* to 9*d*, such as when in the ink supply disabled state. When an ink cartridge 9*a* to 9*d* is replaced in response to the report in step S2, the cover 8*a* is opened by the user. The cover-open state is therefore detected when the user starts the task of replacing ink cartridges 9*a* to 9*d*. When the cover-open state is detected, the controller 50 determines if supplying ink is still not possible (step S4). If not in the ink supply disabled state (step S4: No), an error handling process such as prohibiting printing or other mechanical operations executes (step S9). The printer 1 therefore goes to an error mode in which printing is disabled.

If the ink supply disabled state is still active (step S4: Yes), control goes to step S5. In step S5, whether or not a print job is executing (active, or not finished) is determined. If printing is not in progress (step S5: No), there is no concern about printing being interrupted, control goes to step S9, and the error handling process executes. If printing is in progress (step S5: Yes), control goes to step S6.

In step S6, whether or not the amount of ink in the pressure control chambers 13*a* to 13*d* that function as buffer tanks is greater than the amount of ink (a specific/dependent ink volume) expected to be consumed by (or to finish) the current print job that is executing is determined. In other words, whether or not there is enough ink in the buffer tanks to finish the current print job is determined. The amount of ink in the pressure control chambers 13*a* to 13*d* may be the remaining ink volume detected by the second remaining ink sensors 55*a* to 55*d*, or the maximum capacity of the pressure control chambers 13*a* to 13*d*. The amount of ink expected to be consumed by the print job may also be estimated based on the content of the print job. The controller 50 can also calculate ink consumption as the total amount of each color of ink ejected from the inkjet head 7.

If the ink in the pressure control chambers 13*a* to 13*d* is less than the amount of ink expected to be consumed (step S6: No) to finish the current print job, the controller 50 goes to step S9 and executes the error handling process. This is because there is a strong possibility that ink will run out while printing. As a result, control goes to step S9 and printing is interrupted (stopped). If the ink in the pressure control chambers 13*a* to 13*d* is greater than the amount of ink expected to be consumed (step S6: Yes), ink is unlikely to run out while printing. As a result, control goes to step S7.

Instead of blocking printing or other mechanical operations, a warning indicating that the cover is open is displayed in step S7. For example, an indicator at a specific location may turn on, a message may be displayed on the operating panel of the printer 1, or a command may be sent to the host device. Control then goes to step S8 and the printing process in progress continues.

Printing continues by using the ink stored in the pressure control chambers 13*a* to 13*d* in step S8. That the cover 8*a* changed from the cover-open state to the cover-closed state may be detected in step S8. It may be expected in this event that the ink cartridges 9*a* to 9*d* that were in the ink-end state were replaced and filled new ink cartridges 9*a* to 9*d* were installed to the cartridge holder 8. Ink can therefore be supplied by the diaphragm pump unit 12 from the ink cartridges 9*a* to 9*d* to the pressure control chambers 13*a* to 13*d* if it is detected in step S8 that the cover 8*a* moved from the cover-open state to the cover-closed state.

Returning to step S1, if an ink supply disabled state is not detected by the ink-end evaluation unit 51 (step S1: No), whether or not the cover 8*a* was opened is detected (step S10). If the cover 8*a* is closed (step S10: No) control returns to step S1. If the cover 8*a* is open (step S10: Yes), the cover 8*a* was likely opened accidentally because there is no need to replace the ink cartridges. If the cover 8*a* is opened mistakenly even though there is no need to replace an ink cartridge, printing problems may result from the user touching the moving inkjet head 7 or one of the ink cartridges 9*a* to 9*d* being removed and not replaced, for example. Therefore, if an ink supply disabled state is not detected, but a cover-open state is detected while printing is in progress (step S11: Yes), printing is stopped because a printer 1 error occurred and the printer 1 cannot print (step S9).

If an ink supply disabled state is not detected, but a cover-open state is detected while printing is not in progress (step S11: No), control returns to step S10 to continue detecting the open/closed state of the cover 8*a* until the cover 8*a* closes. Before returning to step S10, the cover-open state is reported and detecting the open/closed state of the cover 8*a* continues until the cover 8*a* closes.

Operating Effect

As described above, this embodiment of the invention can detect if an ink supply disabled state in which ink cannot be supplied from the ink cartridges 9*a* to 9*d* has occurred. An ink supply disabled state occurs when a cover-open state (in which a cover 8*a* that opens and closes the cartridge holder 8 is open) is detected, and instead of throwing an error if printing is in progress, printing continues using ink stored in the pressure control chambers 13*a* to 13*d* functioning as buffer tanks. Printing therefore does not stop even if a cover-open state is detected while ink cartridges 9*a* to 9*d* are being replaced and printing is in progress. Printing is therefore not disabled when a cover-open state is detected while ink cartridges 9*a* to 9*d* are being replaced. Interrupting printing due to a cover open error can therefore be avoided when printing continues while replacing ink cartridges 9*a* to 9*d*.

This embodiment of the invention determines if the amount of ink in the pressure control chambers 13*a* to 13*d* is less than the amount of ink that will be consumed while replacing the ink cartridges, enters an error state if the amount is less, and continues printing if the amount is more than the amount of ink that will be (or is expected to be) consumed while replacing the ink cartridges. Printing continuing while sufficient ink cannot be supplied from the pressure control chambers 13*a* to 13*d* to inkjet head 7 can therefore be avoided.

When a cover-open state of the cover 8*a* that opens and closes the cartridge holder 8 is detected, this embodiment of the invention displays a warning if ink still cannot be supplied and printing is in progress. Because a warning is thus displayed instead of reporting an error if a cover-open state is detected while ink cartridges are being replaced, a warning about the cover being open can be presented without interrupting printing.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A control method of a printing device configured to supply ink from an ink cartridge installed in a cartridge holder through a buffer tank to a printhead, comprising:

monitoring an ink supply of the ink cartridge, and detecting an ink-end state in response to the ink supply in the ink cartridge being not greater than a predetermined amount;

monitoring an open and closed position of a cover over the cartridge holder, and detecting an cover-open state in response to the cover being open and detecting a cover-closed state in response to the cover being closed;

stopping printing in response to not detecting the ink-end state and detecting the cover-open state while printing; and continuing printing using ink from the buffer tank in response to detecting the ink-end state and detecting the cover-open state while printing.

2. The control method of a printing device described in claim 1, further comprising:

in response to a change of detection from the cover-open state to the cover-closed state while printing using ink in the buffer tank, initiating supplying ink from the ink cartridge installed in the cartridge holder to the buffer tank.

3. The control method of a printing device described in claim 2, wherein:

ink is supplied from the ink cartridge to the buffer tank using a diaphragm pump configured to supply ink to the buffer tank;

the diaphragm pump having a displaceable diaphragm whose displacement changes the capacity of a pump ink chamber; and detection of the ink-end state is based on displacement of the diaphragm.

4. The control method of a printing device described in claim 1, further comprising:

in response to detecting the ink-end state and detecting the cover-open state while printing, stopping printing when an amount of ink in the buffer tank is determined to be less than a specific buffer amount.

5. The control method of a printing device described in claim 4, wherein the specific buffer amount is determined to be an amount sufficient for finishing a current print job.

6. The control method of a printing device described in claim 1, wherein the ink-end state indicates that ink cannot be supplied from the ink cartridge.

7. A printing device comprising:

a cartridge holder in which an ink cartridge is installed;

a cover configured to open and close the cartridge holder;

a first sensor that detects a cover-open state in which the cover is open and a cover-closed state in which the cover is closed;

a printhead configured to print by ejecting ink supplied from the ink cartridge;

a buffer tank disposed in an ink supply path from the ink cartridge holder to the printhead; and a second sensor that detects an ink-end state in which an amount of ink in the ink cartridge is not greater than a predefined amount of ink;

wherein:

the printing device stops printing with the printhead in response to the second sensor not detecting the ink-end state and the first sensor detecting the cover-open state while printing with the printhead, and the printing device continues printing with the printhead using ink from the buffer tank in response to the second sensor detecting the ink-end state and the first sensor detecting the cover-open state while printing with the printhead.

8. The printing device described in claim 7, further comprising a pump; and in response to a change of detection from the cover-open state to the cover-closed state while the printhead is printing using ink in the buffer tank, activating the pump to initiate a supplying of ink from the ink cartridge installed in the cartridge holder to the buffer tank.

9. The printing device described in claim 8, wherein:

the pump is a diaphragm pump configured to supply ink to the buffer tank;

the diaphragm pump having a displaceable diaphragm whose displacement changes the capacity of a pump ink chamber; and the second sensor detects the ink-end state based on displacement of the diaphragm.

10. The printing device described in claim 7, further comprising a controller, wherein:

in response to detecting the ink-end state and detecting the cover-open state while printing, the controller stopping printing when an amount of ink in the buffer tank is determined to be less than a specific buffer amount.

11. The printing device described in claim 10, wherein the controller determines the specific buffer amount to be an amount sufficient for finishing a current print job.

* * * * *